US008485641B2

(12) United States Patent
Kang et al.

(10) Patent No.: US 8,485,641 B2
(45) Date of Patent: Jul. 16, 2013

(54) NOZZLE PLATE AND METHOD OF MANUFACTURING THE SAME

(75) Inventors: Sung-gyu Kang, Yongin-si (KR); Jae-woo Chung, Yongin-si (KR); Young-Ki Hong, Yongin-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 182 days.

(21) Appl. No.: 12/801,616

(22) Filed: Jun. 17, 2010

(65) Prior Publication Data

US 2011/0141195 A1 Jun. 16, 2011

(30) Foreign Application Priority Data

Dec. 11, 2009 (KR) ..... 10-2009-0123399

(51) Int. Cl.
*B41J 2/14* (2006.01)
*C23F 1/00* (2006.01)

(52) U.S. Cl.
USPC ..... 347/47; 216/27

(58) Field of Classification Search
None
See application file for complete search history.

(56) References Cited

U.S. PATENT DOCUMENTS

| | | | | |
|---|---|---|---|---|
| 7,524,035 | B2 * | 4/2009 | Bruinsma et al. | 347/65 |
| 2009/0096835 | A1 * | 4/2009 | Nagata | 347/47 |
| 2010/0053269 | A1 * | 3/2010 | Fujii et al. | 347/45 |

FOREIGN PATENT DOCUMENTS

| | | | |
|---|---|---|---|
| JP | 09-141858 | A | 6/1997 |
| JP | 09-254385 | A | 9/1997 |
| JP | 2004-209708 | A | 7/2004 |
| JP | 2006-181926 | | 7/2006 |
| KR | 10-2005-0007409 | | 1/2005 |
| KR | 10-2009-0037119 | | 4/2009 |

* cited by examiner

*Primary Examiner* — Matthew Luu
*Assistant Examiner* — Lisa M Solomon
(74) *Attorney, Agent, or Firm* — Harness, Dickey & Pierce, P.L.C.

(57) ABSTRACT

Provided is a nozzle plate and methods of manufacturing the nozzle plate. The nozzle plate may include a substrate having a nozzle. The nozzle plate may also include a permittivity reducing area in an upper portion of the substrate around the nozzle, wherein the permittivity reducing area includes a plurality of porosities and a plurality of walls between the plurality of porosities. Additionally, the nozzle plate may include a protection layer on the substrate, wherein the protection layer covers the plurality of porosities and the plurality of walls.

13 Claims, 9 Drawing Sheets

NOZZLE PLATE AND METHOD OF MANUFACTURING THE SAME

CROSS-REFERENCE TO RELATED APPLICATIONS

This application claims priority under 35 U.S.C. §119 to Korean Patent Application No. 10-2009-0123399, filed on Dec. 11, 2009, in the Korean Intellectual Property Office (KIPO), the entire contents of which are herein incorporated by reference.

BACKGROUND

1. Field

Example embodiments relate to nozzle plates, and more particularly, to nozzle plates for inkjet heads. Example embodiments also relate to methods of manufacturing the nozzle plates.

2. Description of the Related Art

Inkjet technology is being developed not only for graphics printing but also for fields such as industrial printable electronics and biotechnology. The inkjet technology may be easily applied not only to hard substrates but also flexible substrates such as plastic substrates. The inkjet technology may also reduce material costs. Additionally, the inkjet technology may be applied to new application fields such as flexible displays or low cost radio frequency identification (RFID) tags.

In order to apply the inkjet technology to fields such as printable electronics, relatively high printing speeds, relatively high drop positioning accuracies, and relatively minute droplet volumes may be required. However, these requirements are not easily met in piezoelectric inkjet heads or thermal inkjet heads of the related art. In particular, there are physical limitations in terms of realizing minute droplets having femto-level volumes with a high drop positioning accuracy because when the volumes of droplets are reduced to the level of femtoliters, the influence of drag force due to air resistance on the droplet speed is increased.

Electrohydrodynamic (EHD) inkjet heads for ejecting minute droplets are being researched. In some conventional EHD inkjet heads, a nozzle with a protruded structure is provided. In the conventional EHD inkjet head, droplet speeds and a volume of a droplet may be affected by an intensity of an electric field at an end portion of the nozzle. However, since an EHD inkjet head may use only one nozzle, it may be difficult to increase the printing speed. To solve this printing speed problem, a hybrid type inkjet head in which EHD inkjet technology and piezoelectric or thermal inkjet technology are combined has been developed.

In the hybrid type inkjet head, an intensity of an electric field may be increased at an end of each nozzle, and to this end, permittivity of a region around the nozzles may be reduced due to the nozzles having protruded structures. However, the nozzles having protruded structures are not only mechanically fragile but also cleaning of the nozzles is difficult if ink wetting is generated around the nozzles.

SUMMARY

Provided are nozzle plates and methods of manufacturing the nozzle plates.

Additional aspects will be set forth in part in the description which follows and, in part, will be apparent from the description, or may be learned by practice of example embodiments.

In accordance with example embodiments, a nozzle plate may include a substrate including a nozzle. The nozzle plate may also include a permittivity reducing area in an upper portion of the substrate around the nozzle, wherein the permittivity reducing area includes a plurality of porosities and a plurality of walls between the plurality of porosities. Additionally, the nozzle plate may include a protection layer on the substrate, wherein the protection layer covers the plurality of porosities and the plurality of walls.

In accordance with example embodiments, a method of manufacturing a nozzle plate may include providing a substrate, forming a first etch mask having a nozzle pattern and a first area pattern on the substrate, forming a second etch mask having a second area pattern on the first etch mask, forming a plurality of second porosities by sequentially etching the first etch mask and an upper portion of the substrate through the second etch mask, removing the second etch mask and forming a nozzle and a plurality of first porosities by etching the substrate through the first etch mask, removing the first etch mask and forming a plurality of walls by oxidizing at least a portion of a substrate material between the first and second porosities, and forming a protection layer on the substrate to cover the plurality of first and second porosities and the plurality of walls.

In accordance with example embodiments, a method of manufacturing a nozzle plate may include providing a substrate, forming a first etch mask having a first area pattern on the substrate, forming a second etch mask having a nozzle pattern on the first etch mask and etching the first etch mask through the second etch mask, forming a third etch mask having a second area pattern on the second etch mask, forming a plurality of second porosities by sequentially etching the second and first etch masks and an upper portion of the substrate through the third etch mask, removing the third etch mask and forming an upper portion of a nozzle by sequentially etching the first etch mask and the upper portion of the substrate through the second etch mask, removing the second etch mask and forming the nozzle and a plurality of first porosities by etching the substrate through the first etch mask, removing the first etch mask and forming a plurality of walls by oxidizing at least a portion of a substrate material between the first and second porosities, and forming a protection layer on the substrate so as to cover the plurality of first and second porosities and the plurality of walls.

According to example embodiments, a nozzle plate may include a nozzle plate including a substrate in which a nozzle plate is formed, a permittivity reducing area formed in an upper portion of the substrate around the nozzle and comprising a plurality of porosities and a plurality of walls formed between the plurality of porosities, and a protection layer formed on the substrate to cover the plurality of porosities and the plurality of walls.

A cross-section of the plurality of porosities may have a honeycomb shape or a polygonal shape.

The plurality of walls may be formed of an oxide. For example, the substrate may be formed of silicon and the plurality of walls may be formed of a silicon oxide.

The plurality of walls may be formed of an oxide of a material of the substrate and the material of the substrate.

The permittivity reducing area may include a first area disposed in an outer portion of the nozzle and a second area disposed in an outer portion of the first area. The first area may include a plurality of first porosities at a predetermined depth, and the second area may include a plurality of second porosities having a deeper depth than the plurality of first porosities.

The plurality of first porosities may have a smaller depth than the depth of the nozzle.

The protection layer may be formed of a tetraethoxysilane (TEOS) oxide. The nozzle plate may further include a damper formed in a lower portion of the substrate and the damper may be connected in line with the nozzle.

In accordance with example embodiments, a method of manufacturing a nozzle plate may include forming a first etch mask having a nozzle pattern and a first area pattern, on a substrate, forming a second etch mask having a second area pattern on the first etch mask, forming a plurality of second porosities by sequentially etching the first etch mask and an upper portion of the substrate through the second etch mask, removing the second etch mask and then forming a nozzle and a plurality of first porosities by etching the substrate through the first etch mask, removing the first etch mask and then forming a plurality of walls by oxidizing at least a portion of a substrate material between the first and second porosities, and forming a protection layer on the substrate so as to cover the plurality of first and second porosities and the plurality of walls.

The first etch mask may be formed of an oxide that may be formed by thermally oxidizing an upper surface of the substrate. The second etch mask may be formed of a photoresist.

The plurality of first and second porosities may be formed by using an inductively coupled plasma (ICP) deep etching method. The substrate material between the plurality of first and second porosities may be oxidized using a thermal oxidization method.

The protection layer may be formed by depositing a tetraethoxysilane (TEOS) oxide on the substrate by using a chemical vapor deposition (CVD) method.

In accordance with example embodiments, a method of manufacturing a nozzle plate may include forming a first etch mask having a first area pattern, on a substrate, forming a second etch mask having a nozzle pattern on the first etch mask and then etching the first etch mask through the second etch mask, forming a third etch mask having a second area pattern on the second etch mask, forming a plurality of second porosities by sequentially etching the second and first etch masks and an upper portion of the substrate through the third etch mask, removing the third etch mask and then forming an upper portion of a nozzle by sequentially etching the first etch mask and the upper portion of the substrate through the second etch mask, removing the second etch mask and then forming the nozzle and a plurality of first porosities by etching the substrate through the first etch mask, removing the first etch mask and then forming a plurality of walls by oxidizing at least a portion of a substrate material between the first and second porosities, and forming a protection layer on the substrate so as to cover the plurality of first and second porosities and the plurality of walls.

BRIEF DESCRIPTION OF THE DRAWINGS

These and/or other aspects will become apparent and more readily appreciated from the following description of example embodiments, taken in conjunction with the accompanying drawings of which.

DETAILED DESCRIPTION

Figure 1:
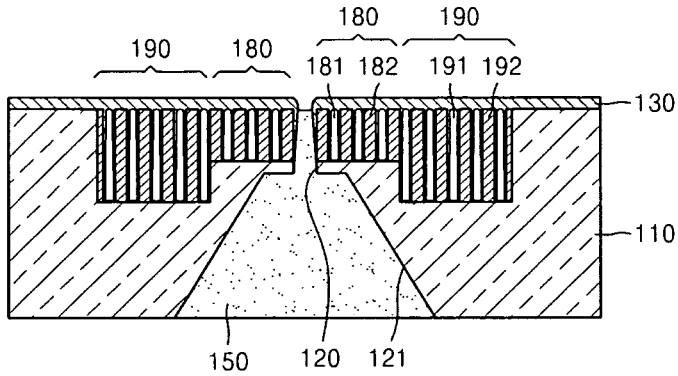
FIG. 1 is a cross-sectional view illustrating a nozzle plate according to example embodiments.

Reference will now be made in detail to example embodiments illustrated in the accompanying drawings, wherein like reference numerals refer to like elements throughout.

In this regard, the example embodiments may have different forms and should not be construed as being limited to the descriptions set forth herein. Accordingly, example embodiments are merely described below, by referring to the figures, to explain aspects of the present description.

Example embodiments will now be described more fully with reference to the accompanying drawings, in which example embodiments are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the sizes of components may be exaggerated for clarity.

It will be understood that when an element or layer is referred to as being "on", "connected to", or "coupled to" another element or layer, it can be directly on, connected to, or coupled to the other element or layer or intervening elements or layers that may be present. In contrast, when an element is referred to as being "directly on", "directly connected to", or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section. Thus, a first element, component, region, layer, or section discussed below could be termed a second element, component, region, layer, or section without departing from the teachings of example embodiments.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Embodiments described herein will refer to plan views and/or cross-sectional views by way of ideal schematic views. Accordingly, the views may be modified depending on manufacturing technologies and/or tolerances. Therefore, example embodiments are not limited to those shown in the views, but include modifications in configuration formed on the basis of manufacturing processes. Therefore, regions exemplified in figures have schematic properties and shapes of regions shown in figures exemplify specific shapes or regions of elements, and do not limit example embodiments.

Figure 2:
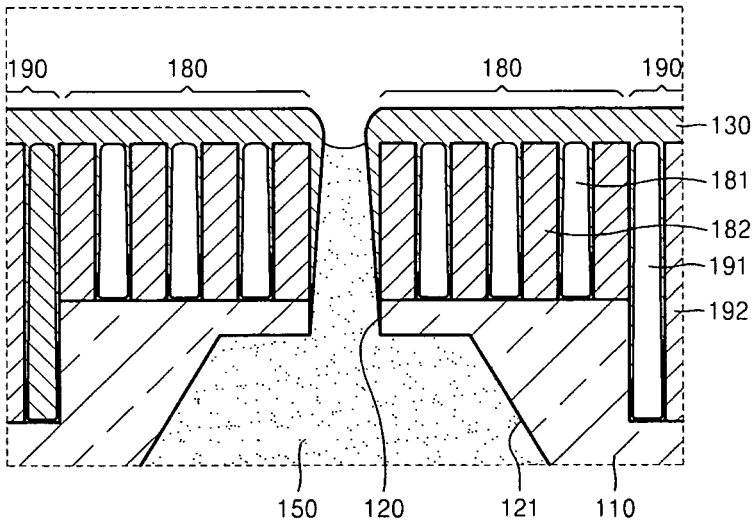
FIG. 2 is an extended view of a region around a nozzle illustrated in FIG. 1.

FIG. 1 is a cross-sectional view illustrating a nozzle plate according to example embodiments, and FIG. 2 is an extended view of a region around a nozzle illustrated in FIG. 1.

Referring to FIGS. 1 and 2, the nozzle plate may include a substrate 110 in which a nozzle 120 is formed. As shown in FIGS. 1 and 2, the nozzle 120 may be formed in an upper portion of the substrate 110 and permittivity reducing areas 180 and 190 may be formed in an upper portion of the substrate 110 around the nozzle 120. The substrate 110 may be a silicon substrate or any other type of substrate. For example, the substrate 110 may be a silicon wafer having a <100> crystallization direction. The nozzle 120 may have a diameter of, for example, about 10 μm, but example embodiments are not limited thereto. Also, a damper 121, connected in line with the nozzle 120, may be formed in a lower portion of the substrate 110. The damper 121 may have a cross-section that tapers toward the upper portion of the substrate 110. Ink 150, for example, charged ink, may be filled in the nozzle 120 and the damper 121.

The permittivity reducing areas 180 and 190 may be formed in the upper portion of the substrate 110 around the nozzle 120. The permittivity reducing areas 180 and 190 may include a plurality of porosities 181 and 191 filled with air and a plurality of walls 182 and 192 may be formed between the porosities 181 and 191. The permittivity reducing areas 180 and 190 may include a first area 180 that is formed in an outer portion of the nozzle 120 and a second area 190 that is formed in an outer portion of the first areas 180. The first area 180 may include a plurality of first porosities 181 and a plurality of walls 182 between the first porosities 181. The first porosities 181 may be formed at a depth smaller than a depth of the nozzle 120. The second areas 190 may include a plurality of second porosities 191 and a plurality of second walls 192 between the second porosities 191. The second porosities 191 may be formed at a deeper depth than the first porosities 181.

The first and second porosities 181 and 191 may have honeycomb-shaped cross-sections but example embodiments are not limited thereto. For example, the first and second porosities 181 and 191 may have polygonal cross-sections, for example, triangular or square cross-sections. The first and second porosities 181 and 191 may have diameters of, for example, about 1 μm to about 10 μm. The first and second walls 182 and 192 may be formed of an oxide, for example, an oxide of a material that the substrate 110 is formed of. For example, the first and second walls 182 and 192 may be formed of a silicon oxide. The first and second walls 182 and 192 may have a thickness of about 1 μm to about 10 μm.

A protection layer 130 may be formed on the substrate 110 to cover the first and second porosities 181 and 191 and the first and second walls 182 and 192. The protection layer 130 may also be formed on sidewalls of the first and second walls 182 and 192 and on inner walls of the nozzle 120 as illustrated in FIG. 2. Due to the protection layer 130, the first and second porosities 181 and 191 may be sealed. Also, due to the protection layer 130, the nozzle plate according to example embodiments may have a planar upper surface in a region around the nozzle 120. The protection layer 130 may be formed of an oxide but example embodiments are not limited thereto. For example, the protection layer 130 may be formed of a tetraethoxysilane (TEOS).

The permittivity reducing areas 180 and 190 may have a lower permittivity than the material of the substrate 110 around the nozzle 120. For example, if the substrate 110 is formed of silicon having a dielectric constant of about 14, the permittivity reducing areas 180 and 190 may include the plurality of first and second porosities 181 and 191 formed of air having a dielectric constant of 1 and the plurality of walls 182 and 192 formed of a silicon oxide having a dielectric constant of about 4, thus the permittivity reducing areas 180 and 190 may have a far lower permittivity than silicon. Accordingly, if an electric field is formed around the nozzle 120, the electric field may be concentrated toward the nozzle 120 filled with the charged ink 120. When the nozzle plate according to example embodiments is applied to an electrohydrodynamic (EHD) inkjet head or a hybrid type inkjet head in which an EHD inkjet head and a piezoelectric or thermal inkjet head are combined, the ejection speed of droplets and drop positioning accuracy thereof may be increased, and ink droplets of very minute volumes to the femto-level may be ejected. Also, as the upper surface of the nozzle plate may be planar, a robust inkjet head may be manufactured, and maintenance, for example, cleaning of the nozzle plate, may also be relatively easily performed.

Figure 3:
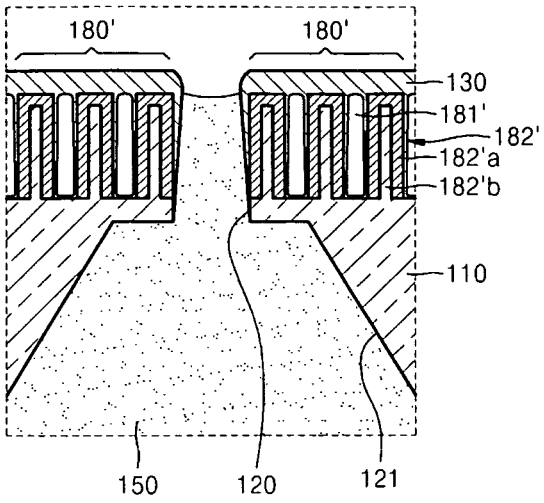
FIG. 3 is a cross-sectional view illustrating a nozzle plate according to example embodiments.

FIG. 3 is a cross-sectional view illustrating a nozzle plate according to example embodiments. The following description will focus on differences between example embodiments of FIGS. 1 and 2 and example embodiments of FIG. 3.

Referring to FIG. 3, a first area 180' may be disposed in an outer portion of a nozzle 120. The first area 180' may include first walls 182' between first porosities 181'. The first walls 182' may include a substrate material 182'*b* and an oxide 182'*a* surrounding the substrate material 182'*b*. For example, when the substrate 110 is formed of silicon, the first wall 182' may be formed of silicon and a silicon oxide that surrounds the silicon. If a thickness of the first wall 182' is relatively large, the first wall 182' may be formed of the substrate material 182'*b* and the oxide 182'*a* as described above. For example, when the substrate 110 is formed of silicon, and the thickness of the first wall 182' is larger than about 2 μm, the first wall 182' may be formed of silicon and a silicon oxide that surrounds silicon. Although not shown in FIG. 3, in a second area in an outer portion of the first area 180', a plurality of second walls (not shown) may be formed between a plurality of second porosities (not shown) and each of the second walls may also be each formed of a substrate material and an oxide surrounding the substrate material like the first area 180'.

FIGS. 4 through 9 are cross-sectional views illustrating a method of manufacturing a nozzle plate according to example embodiments.

Figure 4:
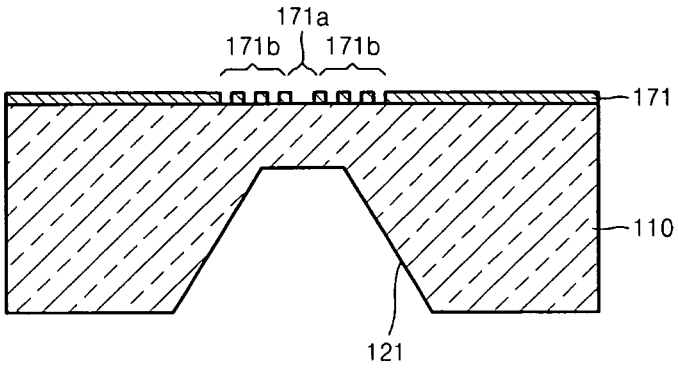
FIGS. 4 through 9 are cross-sectional views illustrating a method of manufacturing a nozzle plate, according to example embodiments.

Referring to FIG. 4, first, a substrate 110 is provided. The substrate 110 may be a silicon substrate or any other type of substrate that may be formed of various materials. For example, the substrate 110 may be a silicon wafer having a <100> crystallization direction. A damper 121 may be formed by etching a lower surface of the substrate 110. The damper 121 may be formed to have a shape whose cross-section tapers toward an upper portion of the substrate 110 by etching the lower surface of the substrate 110 at an inclination angle that may or may not be predetermined. A first etch mask 171 having a nozzle pattern 171*a* and a first area pattern 171*b* may be formed on an upper surface of the substrate 110. The first area pattern 171*b* may be disposed in an outer portion of the nozzle pattern 171*a*. The nozzle pattern 171*a* may have a shape corresponding to a nozzle 120 of FIG. 6, which will be described later, and the first area pattern 171*b* may have a shape corresponding to first porosities 181 of FIG. 6, which will also be described later. The first etch mask 171 may be formed by thermally oxidizing the upper surface of the substrate 110 to form an oxide layer and patterning the oxide layer. When the substrate 110 is formed of, for example, silicon, the first etch mask 171 may be formed of a silicon oxide.

Figure 5:
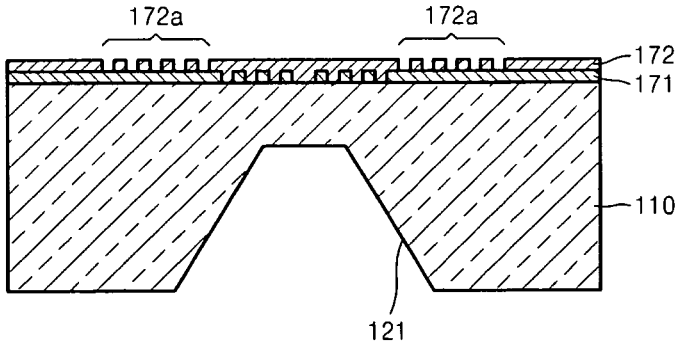

Referring to FIG. 5, a second etch mask 172 may have a second area pattern 172*a* formed on the first etch mask 171. The second area pattern 172*a* may be disposed in an outer portion of the first area pattern 171*b*. The second area pattern 172*a* may have a shape corresponding to second porosities 191 of FIG. 6, which will be described later. The second etch mask 172 may be formed by coating the first etch mask 171 with a photoresist to cover the first etch mask 171 and patterning the photoresist.

Figure 6:
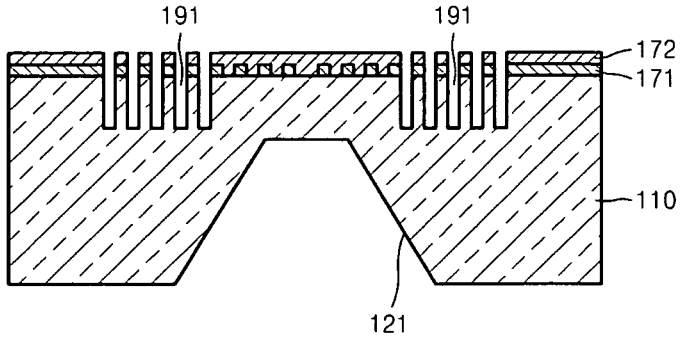

Referring to FIG. 6, the first etch mask 171 may be etched using the second etch mask 172. Accordingly, a pattern corresponding to the second area pattern 172*a* may be formed in the first etch mask 171, and thus the upper surface of the substrate 110 may be exposed through the pattern. The first etch mask 171 may be etched using a dry etching method or a wet etching method. In example embodiments, the upper surface of the substrate 110 may be etched using the first and second etch mask 171 and 172, thereby forming a plurality of second porosities 191. In example embodiments, the upper surface of the substrate 110 may be etched to a depth that may or may not be predetermined. The second porosities 191 may be formed by using a dry etching method. For example, the second porosities 191 may be formed by etching the substrate 110 using an inductively coupled plasma (ICP) deep etching method. The second porosities 191 may be formed to have, for example, honeycomb-shaped or polygonal cross-sections. The second porosities 191 may be formed to have diameters of, for example, about 1 μm to about 10 μm, but example embodiments are not limited thereto. In example embodiments, the second etch mask 172 may be removed.

Figure 7:
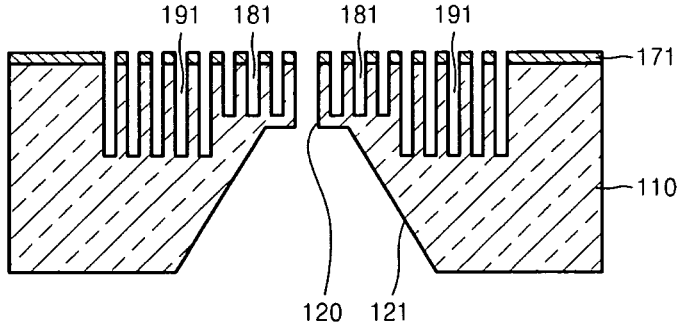

Referring to FIG. 7, the upper surface of the substrate 110 may be etched through the first etch mask 171. Accordingly, a nozzle 120 may be formed in an upper portion of the substrate 110, corresponding to the nozzle pattern 171*a*, and first porosities 181 may be formed between the nozzle 120 and the second porosities 191 in correspondence to the first area pattern 171*b*. In example embodiments, the first porosities 181 may be formed to a depth that may or may not be predetermined. The nozzle 120 may be formed to have a diameter, for example, about 10 μm. The first porosities 181 may be formed to have diameters of, for example, about 1 μm to about 10 μm, but example embodiments are not limited thereto. The nozzle 120 may be formed to have, for example, a circular cross-section, and the first porosities 181 may be formed to have, for example, honeycomb-shaped or polygonal cross-sections. The nozzle 120 and the first porosities 181 may also be formed by using a dry etching method like the second porosities 191. For example, the nozzle 120 and the first porosities 181 may be formed by etching the substrate 110 by using the ICP deep etching method. An etch rate of the substrate 110 is slowed down as a width of a portion being etched decreases, and thus if a diameter of the first porosities 181 is smaller than a diameter of the nozzle 120, the first porosities 181 may be formed to a smaller depth than the nozzle 120 as illustrated in FIG. 7. Because the substrate 110 may also be etched using the patterns formed in the first etch mask in correspondence to the second area pattern 172*a*, the second porosities 191 may be formed to a deeper depth than illustrated in FIG. 6. Accordingly, the second porosities 191 may be formed to a deeper depth than the first porosities 181. In example embodiments, the first etch mask 171 may be removed.

Figure 8:
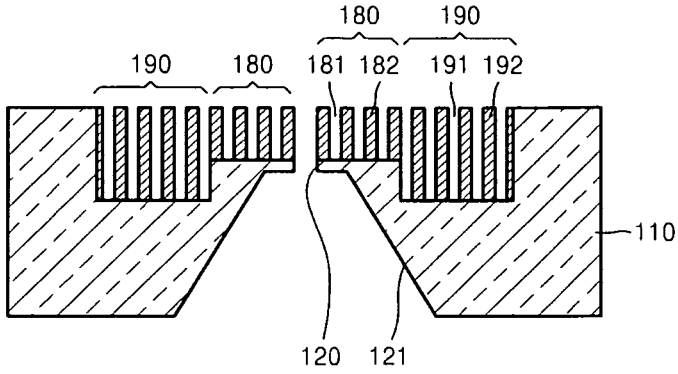

Referring to FIG. 8, a substrate material between the first and second porosities 181 and 191 may be oxidized to form a plurality of first and second walls 182 and 192. For example, the first and second walls 182 and 192 may be formed by, for example, thermally oxidizing the substrate material between the first and second porosities 181 and 191. Accordingly, the first and second walls 182 and 192 may be formed of an oxide of the substrate material. For example, if the substrate 110 is formed of silicon, the first and second walls 182 and 192 may be formed of a silicon oxide. If a thickness of the substrate material between the first and second porosities 181 and 191 is relatively large, only a portion of the substrate material may be oxidized, and thus the first and second walls 182 and 192 may be formed of the substrate material and the oxide surrounding the substrate material as illustrated in FIG. 3.

Figure 9:
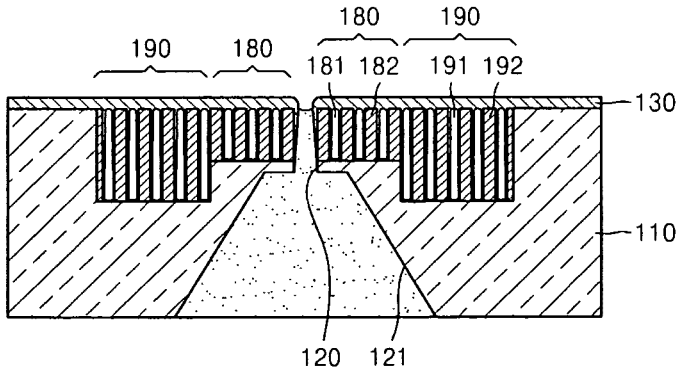

Referring to FIG. 9, by forming a protection layer 130 on the substrate 110 to cover the first and second porosities 181 and 191 and the first and second walls 182 and 192, the nozzle plate may be completed. The protection layer 130 may also be formed on sidewalls of the first and second walls 182 and 192 in the first and second porosities 181 and 191 and on inner walls of the nozzle 120. The protection layer 130 may be formed on the upper surface of the substrate 110 by depositing a tetraethoxysilane (TEOS) oxide by using a chemical vapor deposition (CVD) method.

FIGS. 10 through 17 are cross-sectional views illustrating a method of manufacturing a nozzle plate according to example embodiments. Here, the description will focus on differences from the example embodiments previously described.

Figure 10:
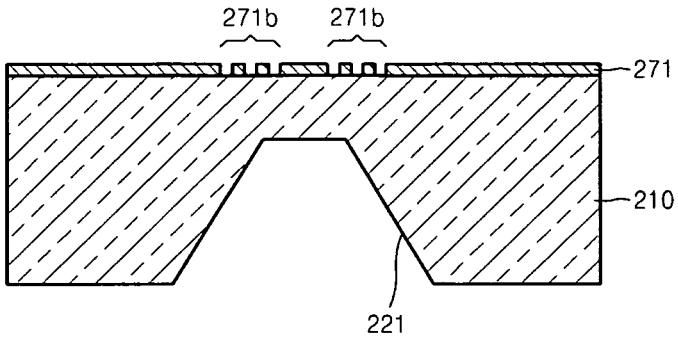
FIGS. 10 through 17 are cross-sectional views illustrating a method of manufacturing a nozzle plate, according to example embodiments.

Referring to FIG. 10, a first etch mask 271 having a first area pattern 271*b* may be formed on an upper surface of a substrate 210. In example embodiments, a damper 221 may be formed in the substrate 210. The substrate 210 may be a silicon wafer having a <100> crystallization direction, and the damper 221 may be formed by etching a lower surface the substrate 210 at an inclination angle such that a cross-section of the damper 221 tapers toward an upper portion of the substrate 210. In example embodiments, the inclination angle may or may not be predetermined. The first area pattern 271*b* may have a shape corresponding to first porosities 281, which are to be described later. The first etch mask 271 may be formed by thermally oxidizing an upper surface of the substrate 210 to form an oxide layer and patterning the oxide layer. For example, when the substrate 210 is formed of silicon, the first etch mask 271 may be formed of a silicon oxide.

Figure 11:
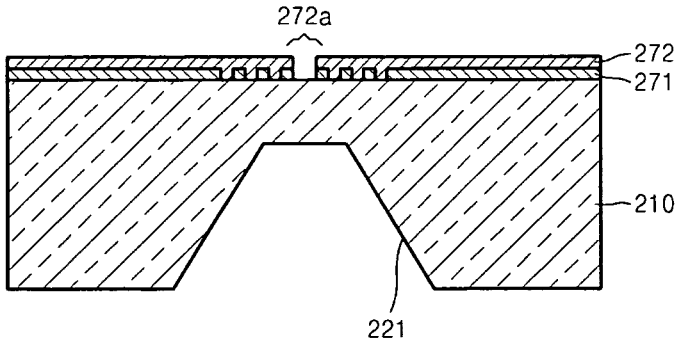

Referring to FIG. 11, a second etch mask 272 may be formed on the first etch mask 271 and the second etch mask 272 have a nozzle pattern 272*a* formed on the first etch mask 271. The second etch mask 272 may be formed by forming, for example, a metal layer to cover the first etch mask 271 and patterning the metal layer. The second etch mask 272 may be formed of a metal such as a chromium (Cr) but example embodiments are not limited thereto. The first etch mask 271 exposed through the nozzle pattern 272*a* may be etched to expose the upper surface of the substrate 210.

Figure 12:
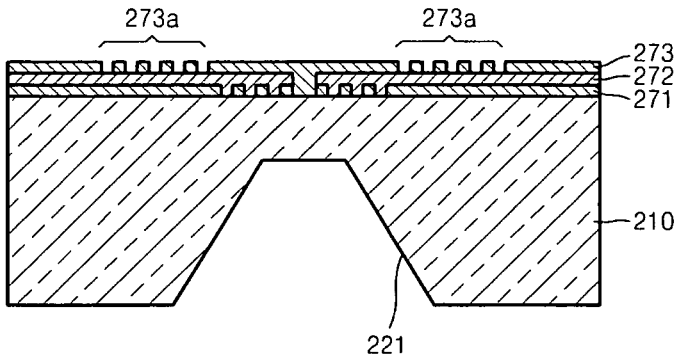

Referring to FIG. 12, a third etch mask 273 having a second area pattern 273*a* may be formed on the second etch mask 272. The second area pattern 273*a* may be disposed in an outer portion of the first area pattern 271*b*. The second area pattern 273*a* may have a shape corresponding to second porosities 291 of FIG. 14 which will be described later. The third etch mask 273 may be formed by coating the second etch mask 272 with a photoresist to cover the second etch mask 272 and patterning the photoresist.

Figure 13:
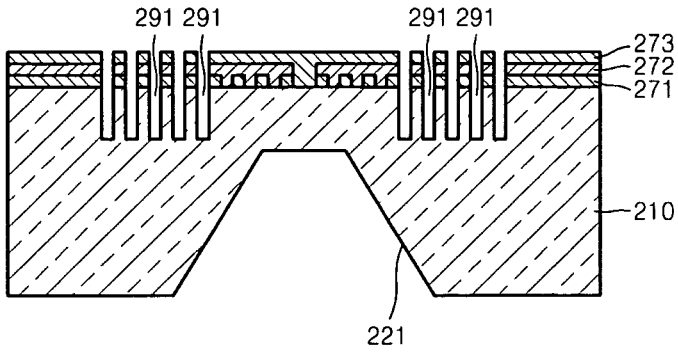

Referring to FIG. 13, the second etch mask 272 and the first etch mask 271 may be sequentially etched through the third etch mask 273. The first and second etch masks 271 and 272 may be etched using a dry etching method or a wet etching method. Accordingly, patterns corresponding to the second area pattern 273*a* may be formed in the first and second etch masks 271 and 272, and the upper surface of the substrate 210 may be exposed through the patterns. The upper surface of the substrate 210 may be etched to a depth through the first through third etch masks 271, 272, and 273, thereby forming a plurality of second porosities 291. In example embodiments, the upper surface of the substrate 210 may be etched to a depth that may or may not be predetermined. The second porosities 291 may be formed by using a dry etching method. For example, the second porosities 291 may be formed by etching the substrate 210 using the ICP deep etching method. The second porosities 291 may be formed to have, for example, honeycomb-shaped or polygonal cross-sections. The second porosities 291 may be formed to have diameters of, for example, about 1 μm to about 10 μm, but example embodiments are not limited thereto. In example embodiments, the third etch mask 273 may be removed.

Figure 14:
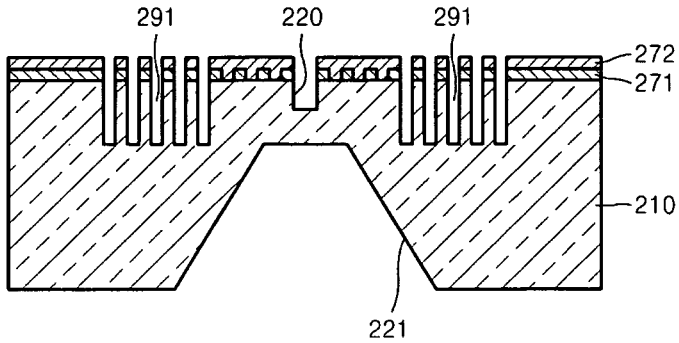

Referring to FIG. 14, the substrate 210 may be etched through the first and second etch mask 271 and 272. Accordingly, an upper portion of a nozzle 220 may be formed in an upper portion of the substrate 210 in correspondence to the nozzle patterns 271*a* and 272*a*. The nozzle 220 may be formed to have a diameter of, for example, 10 μm. The nozzle 220 may be formed to have a circular cross-section but example embodiments are not limited thereto. The upper portion of the nozzle 220 may be formed by using a dry etching method. For example, the upper portion of the nozzle 220 may be formed by etching the substrate 210 using the ICP deep etching method. In example embodiments, because the substrate 210 may be etched through the patterns formed to correspond to the second area pattern 273*a*, the second porosities 291 may be formed to a deeper depth than illustrated in FIG. 13. In example embodiments, the second etch mask 272 may be removed.

Figure 15:
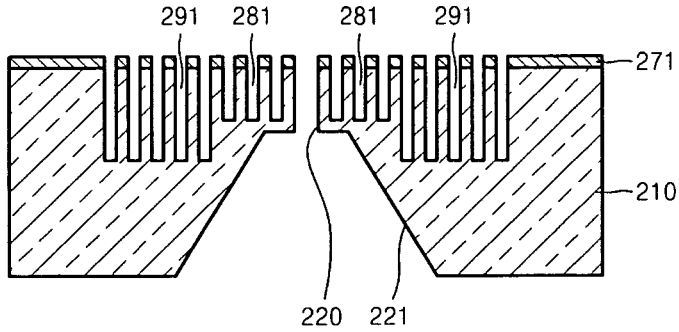

Referring to FIG. 15, the substrate 210 may be etched through the first etch mask 271. Accordingly, the nozzle 220 may be formed to be connected in line with the damper 221, and first porosities 281 may be formed between the nozzle 220 and the second porosities 291, corresponding to the first area pattern 271*b*. In example embodiments, the first porosities 281 may or may not be formed to a predetermined depth in the substrate 210. The first porosities 281 may be formed to have diameters of, for example, about 1 μm to about 10 μm, but example embodiments are not limited thereto. The first porosities 281 may be formed to have, for example, honeycomb-shaped or polygonal cross-sections. The substrate 210 may be etched by using a dry etching method. For example, the substrate 210 may be etched by using the ICP deep etching method.

As described above, according to example embodiments, the upper portion of the nozzle 220 may be formed before the first porosities 281. If the diameters of the first porosities 281 and a diameter of the nozzle 220 are similar, an etch rate of the substrate 210 in the first porosities 281 and an etch rate of the substrate 210 in the nozzle 220 may be similar, and thus when the first porosities 281 and the nozzle 220 are formed at the same time, there are concerns that the first porosities 281 might be connected in line with the damper 221. Accordingly, when the upper portion of the nozzle 220 is formed first as in example embodiments of FIGS. 10-14, the first porosities 281 may be formed at a smaller depth than the nozzle 220 and thus the first porosities 281 may not be connected in line with the damper 221. Since the substrate 210 is also etched here through the first etch mask 271 so as to correspond to the second area pattern 273*a*, the second porosities 291 may be formed at a deeper depth than illustrated in FIG. 14. Accordingly, the second porosities 291 may be formed at a deeper depth than the first porosities 281. In example embodiments, the first etch mask 271 may be removed.

Figure 16:
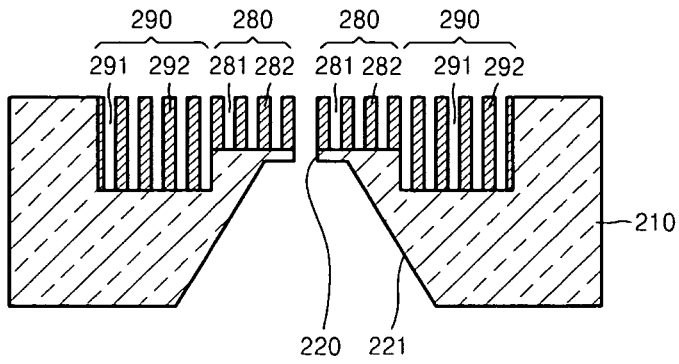

Referring to FIG. 16, first and second walls 282 and 292 may be formed by oxidizing a substrate material between the first and second porosities 281 and 291. The first and second walls 282 and 292 may be formed by, for example, thermally oxidizing the substrate material between the first and second porosities 281 and 291. Accordingly, the first and second walls 282 and 292 may be formed of an oxide of the substrate material. For example, when the substrate 210 is formed of silicon, the first and second walls 282 and 292 may be formed of a silicon oxide. When a thickness of the substrate material between the first and second porosities 281 and 291 is relatively large, only a portion of the substrate material may be oxidized, and accordingly, the first and second walls 282 and 292 may be formed of the substrate material and an oxide surrounding the substrate material as illustrated in FIG. 3.

Figure 17:
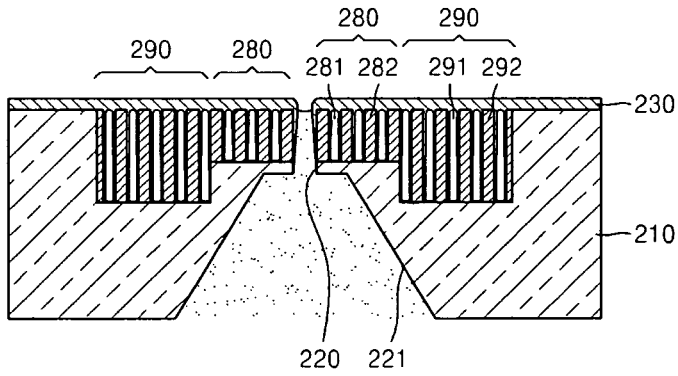

Referring to FIG. 17, by forming a protection layer 230 on the upper surface of the substrate 210 to cover the first and second porosities 281 and 291 and the first and second walls 282 and 292, the nozzle plate may be completed. The protection layer 230 may also be formed on sidewalls of the first and second walls 282 and 292 in the first and second porosities 281 and 291 and on inner walls of the nozzle 220. The protection layer 230 may be formed by depositing a TEOS oxide on the upper surface of the substrate 210 by using, for example, the CVD method.

As described above, according to example embodiments, permittivity reducing areas including a plurality of porosities may be formed in an upper portion of a substrate around a nozzle of a nozzle plate, and thus permittivity of a region around the nozzle may be reduced to be lower than permittivity of a substrate material. Accordingly, an electric field may be concentrated at a tip of the nozzle, thereby manufacturing an inkjet head which is capable of increasing a speed of ejection droplets and drop positioning accuracy thereof and ejecting very minute, femto-level droplets. In addition, an upper surface of the nozzle plate may be planar and thus the inkjet head may have a robust structure, and maintenance such as cleaning of the nozzle plate may also be easily conducted.

While a nozzle plate including one nozzle has been described above with reference to example embodiments, example embodiments are not limited thereto; for example, a plurality of nozzles may also be formed in the nozzle plate. It should be understood that the exemplary embodiments described herein should be considered in a descriptive sense only and not for purposes of limitation. Descriptions of features or aspects within example embodiments should typically be considered as available for other similar features or aspects in other embodiments.

What is claimed is:

1. A nozzle plate comprising:

a substrate including a nozzle;

a permittivity reducing area in an upper portion of the substrate around the nozzle, the permittivity reducing area including a plurality of porosities and a plurality of walls between the plurality of porosities; and a protection layer on the substrate, the protection layer enclosing the plurality of porosities and the plurality of walls such that the plurality of porosities remain between the protection layer and the substrate.

2. The nozzle plate of claim 1, wherein a cross-section of the plurality of porosities has at least one of a honeycomb shape and a polygonal shape.

3. The nozzle plate of claim 1, wherein the plurality of walls includes an oxide.

4. The nozzle plate of claim 1, wherein the substrate includes silicon and the plurality of walls includes silicon oxide.

5. The nozzle plate of claim 1, wherein the plurality of walls includes an oxide of a material of the substrate and the material of the substrate.

6. The nozzle plate of claim 1, wherein the permittivity reducing area includes a first area in an outer portion of the nozzle and a second area in an outer portion of the first area.

7. The nozzle plate of claim 6, wherein the plurality of porosities includes a plurality of first porosities in the first area and a plurality of second porosities in the second area, the plurality of second porosities having a deeper depth than a depth of the plurality of first porosities.

8. The nozzle plate of claim 7, wherein the depth of the plurality of first porosities is smaller than a depth of the nozzle.

9. The nozzle plate of claim 1, wherein the protection layer includes a tetraethoxysilane (TEOS) oxide.

10. The nozzle plate of claim 1, wherein the substrate further includes a damper in a lower portion thereof, the damper being in line with the nozzle.

11. A nozzle plate comprising:

a substrate including a nozzle;

a permittivity reducing area in an upper portion of the substrate around the nozzle, the permittivity reducing area including a first area surrounding the nozzle and a second area surrounding the first area, the first area including a plurality of first porosities and a plurality of first walls between the plurality of first porosities, the second area including a plurality of second porosities and a plurality of second walls between the plurality of second porosities; and a protection layer on the substrate, the protection layer enclosing the plurality of porosities and the plurality of walls such that the plurality of first and second porosities remain between the protection layer and the substrate.

12. The nozzle plate of claim 11, wherein the plurality of second porosities has a deeper depth than the plurality of first porosities.

13. The nozzle plate of claim 12, wherein the depth of the plurality of first porosities is smaller than a depth of the nozzle.

* * * * *